US005680659A

United States Patent [19]

Gessaman

[11] Patent Number: 5,680,659

[45] Date of Patent: Oct. 28, 1997

[54] WATER CONSERVING TOILET FLUSH MECHANISM

[76] Inventor: Robert A. Gessaman, 6515 Calais Ct., Centerville, Ohio 45459

[21] Appl. No.: 612,441

[22] Filed: Mar. 7, 1996

[51] Int. Cl.[6] ..... E03D 1/14

[52] U.S. Cl. ..... 4/325; 4/405

[58] Field of Search ..... 4/324, 325, 405

[56] References Cited

U.S. PATENT DOCUMENTS

| | | | |
|---|---|---|---|
| 3,936,889 | 2/1976 | Wibroe | 4/325 |
| 4,433,445 | 2/1984 | Morris et al. | 4/325 |
| 4,447,919 | 5/1984 | Mobilia | 4/325 |
| 4,941,214 | 7/1990 | Harris | 4/325 |
| 5,235,707 | 8/1993 | Wang-on | 4/324 |

*Primary Examiner*—Charles E. Phillips
*Attorney, Agent, or Firm*—Biebel & French

[57] ABSTRACT

A toilet flush mechanism for use with a toilet including a water tank and a water outlet for conducting water out of the tank. The flush mechanism includes a valve element positioned at the outlet for closing and opening the outlet, and a first actuator for moving the valve element between a fully closed position and a fully open position. A stop member is provided located adjacent to the valve element for engaging the valve element and limiting movement of the valve element to an intermediate position between the fully closed and fully open position during a first mode of operation. A second actuator is provided for moving the stop member away from engagement with the valve element during a second mode of operation whereby the first actuator is operable to move the valve element to the fully open position.

7 Claims, 2 Drawing Sheets

10
16
18
20
22
24
26
28
29
30
32
34
36
38
40
42
44
46
48
49
50
52
54
56
58
60
62
64
65
66
68
70
72
74
76
78
80
82
84
86
88
90
92
94
96
98
100
102
104
106
108
110

WATER CONSERVING TOILET FLUSH MECHANISM

BACKGROUND OF THE INVENTION

The present invention relates to an improved flushing mechanism for a toilet and, more particularly, to a flushing mechanism which permits control of the amount of water flushed from a toilet tank in order to conserve the amount of water used by the toilet.

Various mechanisms for flushing toilets have been developed. One such mechanism which is commonly found in toilet tanks is one wherein a float controls a valve, such as a ballcock assembly and operates in combination with a flapper or tank ball to control water flow into and out of the tank. In operation, the valve permits water to flow into the tank until the water level causes the float to move upwardly whereby a float arm supporting the float moves to close the valve. Thus, a predetermined amount of water is maintained within the tank in between flushing operations. When the trip lever or handle on the toilet is pushed, the flapper or tank ball valve is lifted off of a flush valve outlet to permit the water to flow rapidly downwardly out of the tank. The rapidly flowing water passes into a leg of a trap in the toilet bowl and creates a siphoning effect pulling water in the bowl down a drain.

It has long been recognized that during many flushing operations the entire quantity of water contained within the tank is not required to perform a satisfactory sanitary flush of the toilet bowl. There have been several attempts to provide devices which conserve water during the flushing Of a toilet, however, there continues to exist a need for a simple and easily installed mechanism which provides for controlled use of the water in a toilet tank during a flushing operation.

SUMMARY OF THE INVENTION

The present invention provides a toilet flush mechanism for use in a conventional toilet, such as one including a water tank having a water outlet for conducting water out of the tank to a toilet bowl. Flow through the water outlet is preferably controlled by means of a valve element such as a flapper valve or ball valve.

A handle is supported on a pivot shaft mounted to the toilet tank for pivotal movement to move the valve element between a fully closed and a fully opened position whereby water may be flushed from the tank.

In accordance with the invention, an elongated stop member is supported on a pivot connection above the valve element. An upper portion of the stop member is pivotally mounted at the pivot connection and a lower end of the stop member is positioned a predetermined distance from the valve element in order to limit upward movement of the valve element. With the stop member thus positioned, the valve element is limited to movement to a position intermediate the fully closed and fully open positions.

A stop member actuator is provided for pivoting the stop member from its normal downwardly extending position to a position where it permits the valve element to move upwardly to its fully open position. The stop member actuator includes an actuator shaft which is coaxial with a pivot axis for pivot shaft of the handle. The actuator shaft extends through the pivot shaft and includes an end located within the tank supporting a lever linked to the stop member. Pivotal movement of the lever causes the stop member to pivot away from the valve element thereby permitting full upward movement of the valve element.

The stop member actuator further includes a pawl member supported within the handle for pivotal movement. The pawl member includes an end adapted to engage an abutment portion located on an end of the actuator shaft wherein engagement between the pawl member and abutment portion during pivotal movement of the handle causes the lever to pivot resulting in pivotal movement of the stop member. The pawl member is biased to a disengaged position wherein pivotal movement of the handle will normally not result in rotation of the actuator shaft.

Thus, the toilet flush mechanism of the present invention will normally limit opening of the water outlet for the tank when the handle is actuated such that water will flow out of the tank only as long as the handle is held down. If a full flushing of the toilet tank is required, the stop member actuator may be actuated to permit the valve element to move to its fully open position. In this manner, water may be conserved by using only the amount of water required to flush out the toilet bowl without fully emptying the tank of water.

Therefore, it is an object of the present invention to provide a toilet flush mechanism which provides for a partial flush of a toilet.

It is another object of the invention to provide a toilet flush mechanism wherein a user may optionally select between two modes of operation for flushing the toilet.

It is yet a further object of the invention to provide a toilet flush mechanism which is adapted to conserve water and which is easily retrofit to an existing toilet structure.

Other objects, features and advantages of the invention will be apparent from the following description, the accompnaying drawings and the appended claims.

DETAILED DESCRIPTION OF THE PREFERRED EMBODIMENT

Figures 1, 2, 3:
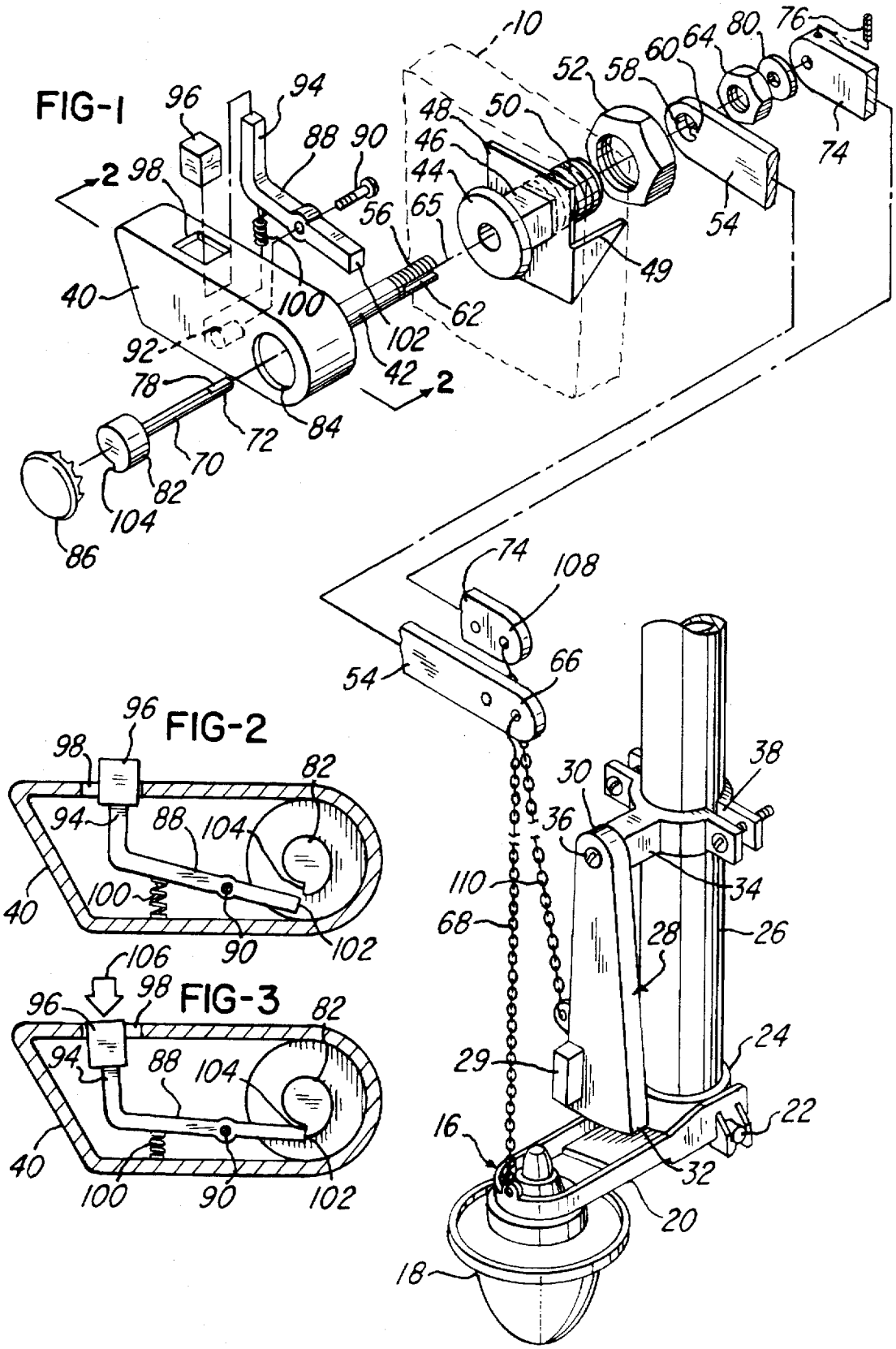
FIG. 1 is a partially exploded perspective view of the toilet flush mechanism of the present invention.
FIG. 2 is a cross-sectional view taken along line 2—2 in FIG. 1 showing the pawl member of the stop member actuator positioned for a first mode of operation.
FIG. 3 is a view similar to FIG. 2 showing the pawl member positioned for a second mode of operation.

Referring initially to FIG. 1, the toilet flush mechanism of the present invention is intended to be used with a conventional toilet including a toilet tank 10 having a water outlet 12 (see FIG. 6) wherein the outlet 12 directs water to a toilet bowl (not shown) and typically includes a valve seat 14.

The flush mechanism shown in FIG. 1 includes a valve element 16 in the form of a flapper valve comprising a sealing element 18 supported by an arm 20. The arm 20 is pivotably supported at pins 22 extending outwardly from a support collar 24 which is mounted to the overflow tube 26. The valve element 16 is supported such that the sealing element 18 will engage the valve seat 14 (FIG. 6) to thereby prevent water flow from the tank 10 through the outlet 12.

A stop member 28 is positioned above the valve element 16 and is formed as an elongated member having an upper end 30 and a lower end 32. The upper end 30 of the stop member 28 is supported for pivotal movement on a pivot support 34 by means of a fastener 36 extending through the upper end 30 and into the pivot support 34. The pivot support 34 is attached to the overflow tube 26 by means of a clamp structure 38. The clamp structure 38 may be loosened and tightened to permit the pivot support 34 to be moved to a desired vertical position whereby a predetermined distance between the lower end 32 and the valve element 16 may be selected.

Figure 6:
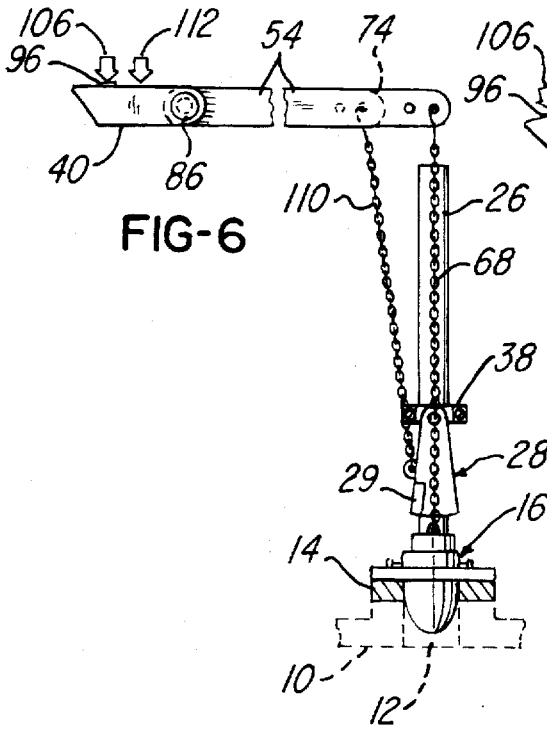
FIGS. 6 and 7 are elevational views showing the flush mechanism in a second mode of operation.
Figure 8:
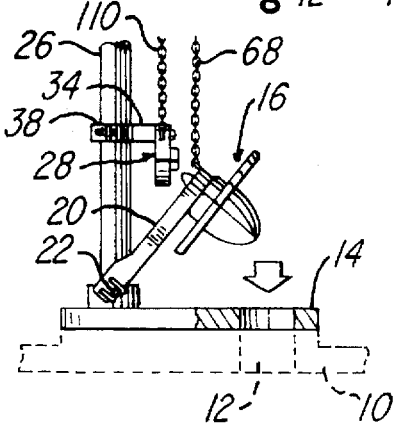
FIG. 8 is an elevational view taken along line 8—8 in FIG. 7.

The lower end 32 of the stop member 28 is positioned such that it will limit upward pivotal movement of the valve element 16 to a position intermediate a fully closed position, as seen in FIG. 6, and a fully open position as seen in FIG. 8. The extent to which the valve element 16 will open in its intermediate position may be controlled by the vertical position of the pivot support 34 along the overflow tube 26.

A first actuator is provided for moving the valve element 16 vertically and includes a handle 40 and a hollow pivot shaft 42 rigidly attached to the handle 40 and extending through a bearing member 44 extending through the wall of the tank 10. The bearing member 44 includes a square shaped portion 46 supporting an inner brace 48 which abuts against an inner surface of the tank 10. The inner brace 48 includes a lever support 49 extending into the tank generally parallel to the bearing member 44. In addition, the bearing member 44 includes a threaded end 50 for receiving a nut 52 to thereby retain the bearing member 44 in place on the wall of the tank.

The first actuator further includes a first lever 54 which is supported on a threaded end 56 of the pivot shaft 42 extending beyond the threaded end 50 of the bearing member 44. An aperture 58 is provided in the first lever 54 for receiving the threaded end 56 and a key 60 extends into the aperture 58 for positioning in a slot 62 formed in a threaded end 56. The first lever 54 is retained on the pivot shaft 42 by means of a nut 64 which is threaded onto the threaded end 56. Thus, the first lever 54 is supported on the pivot shaft 42 for pivotal movement about a pivot axis 65 when the handle 40 is depressed and released.

A distal end 66 of the first lever is attached to the valve element 16 by means of a first link 68, which may be in the form of a chain or equivalent linkage means. The lever 54 normally rests on the lever support 49 and it should be apparent that pivoting movement of the handle 40 results in pivotal movement of the lever 54 within the tank 10 whereby the valve element 16 may be lifted away from the valve seat 14 in order to initiate a flushing operation of the toilet.

A second actuator is provided for moving the stop member 28 away from engagement with the valve element 16 and includes an actuator shaft 70 extending through the pivot shaft 42 coaxial with the pivot axis 65 and including an end portion 72 extending beyond the threaded end 56 for supporting a second lever 74. Preferably, a set screw 76 extends through an end of the lever 74 into engagement with a flat 78 on the end 72 of the actuator shaft 70 to ensure that the second lever 74 pivots with the actuator shaft 70. In addition, a washer 80 may be provided between the second lever 74 and the nut 64 to facilitate independent pivoting movement of the first lever 54 and second lever 74 relative to each other.

A head portion 82 is rigidly connected to an end of the actuator shaft 70 and is positioned within the handle 40. It should be noted that the handle 40 is provided with an enlarged aperture 84 for facilitating assembly of the second actuator and a cap 86 may be provided for covering the aperture 84 subsequent to insertion of the actuator shaft 70 through the pivot shaft 42.

The second actuator further includes a pawl member 88 supported within the handle 40 for pivotal movement by means of a pivot pin 90 attached to an interior portion 92 of the handle 40. The pawl member 88 is L shaped and includes an upwardly extending leg 94 having a cap or button 96 attached thereto. The button 96 extends upwardly through an aperture 98 formed in an upper surface of the handle 40, and a spring 100 is provided for biasing the pawl 88 in movement relative to the handle 40 to position the button 96 extending outwardly from the aperture 98.

Referring further to FIGS. 2 and 3, the pawl member 88 includes an abutment end 102 for engaging an abutment portion 104 on the head portion 82. As seen in FIG. 2, the pawl member 88 is normally biased to a position where the abutment end 102 will not engage the abutment portion 104 during pivotal movement of the handle 40. In the actuated position of the pawl 88, as seen in FIG. 3, the button 96 is depressed in the direction of the arrow 106 such that the abutment end 102 and abutment portion 104 are located in abutting engagement with each other. With the pawl 88 thus positioned, the actuator shaft 70 will rotate with pivoting movement of the handle 40 to thereby cause the second lever 74 to pivot within the tank 10. A distal end 108 of the second lever 74 is connected to the stop member 28 by a second link means 110, which may be in the form of a chain or equivalent linkage means. The second lever 74 normally rests on the lever support 49 and pivoting movement of the second lever 74 results in a pivoting movement of the stop member 28 away from the valve element 16.

Figure 4:
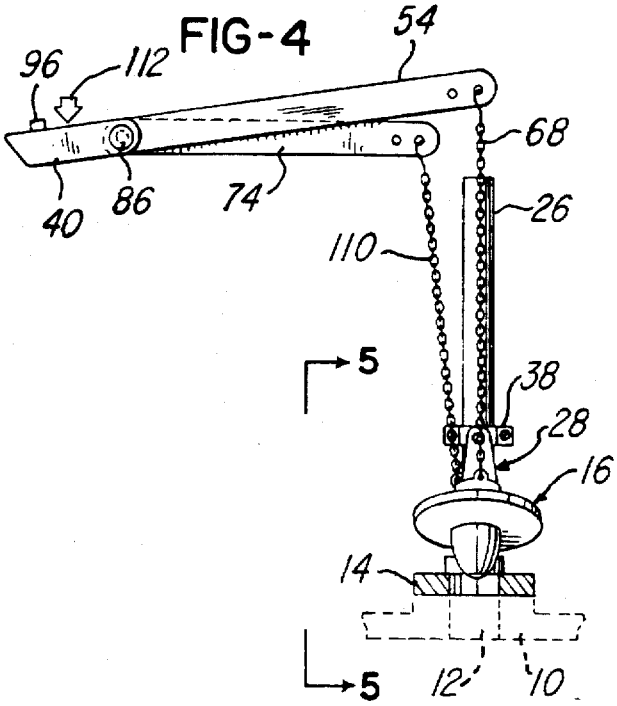
FIG. 4 is an elevational view illustrating the flush mechanism in a first mode of operation.
Figure 5:
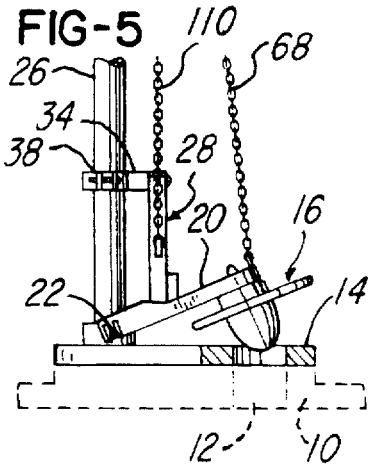
FIG. 5 is an elevational view taken along line 5—5 in FIG. 4.

Referring to FIGS. 4 and 5, a first mode of operation for the flush mechanism is illustrated. During this mode of operation, the stop member 28 is positioned extending downwardly toward the valve element 16 and the handle 40 is actuated, as indicated by arrow 112 to move the distal end 66 of the first lever 54 upwardly. The valve element 16 is caused to move upwardly off of the valve seat 14 and allow water to pass out through the outlet 12. The arm 20 of the valve element 16 contacts the stop member 28 thereby limiting upward movement of the valve element 16 to an intermediate position between the fully open and fully closed positions. It should be noted that the intermediate position illustrated in these figures is selected such that when the handle 40 is released, the valve element 16 will descend back onto the valve seat 14 to terminate flow of water out of the toilet tank 10 without permitting the tank to fully discharge its water. It should also be understood that the stop member 28 is weighted sufficiently, such as by a weight 29 (FIG. 1), to resist being buoyed up when the tank 10 is full of water whereby the stop member 28 will be held by its own weight in a downwardly extending position. Thus, in the first mode of operation, the second actuator will remain unactuated during actuation of the first actuator to thereby permit a person to control the amount of water released from the tank 10.

Figure 7:
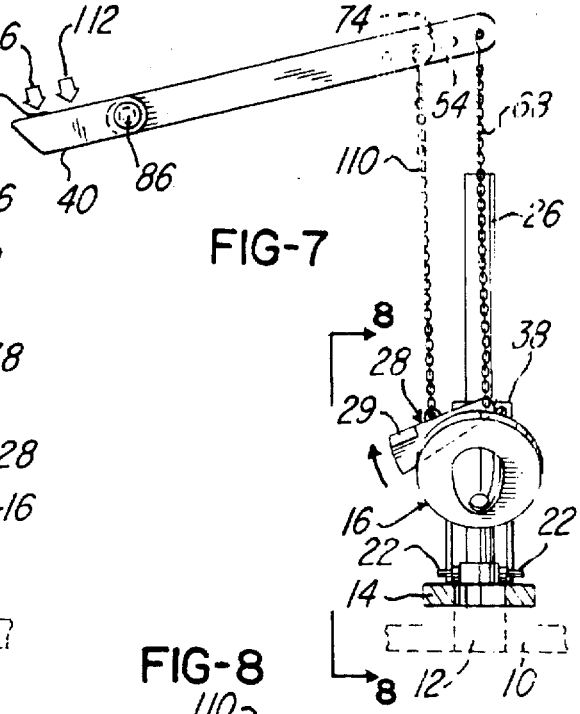

FIGS. 6–8 illustrate a second mode of operation wherein a full flush of the toilet is obtained. During this mode of operation, the button 96 is first depressed as illustrated by arrow 106, while the stop member 28 and valve element 16 are located in the positions illustrated in FIG. 6. Subsequently, the handle is depressed, as indicated by arrow 112, whereby the pivot shaft 42 and actuator shaft 70 pivot together to move the first and second levers 54, 74 simultaneously. During this movement, the stop member 28 will be pivoted upwardly, as illustrated in FIG. 7, to move away from the valve element 16. In this mode of operation, the first lever 54 will pull the valve element 16 to its fully open position and thereby permit a full flush of the toilet to occur wherein the tank 10 discharges substantially all of the water contained therein before the valve element 16 drops back into position on the valve seat 14.

From the above description, it should be apparent that the first lever 54 controlling movement of the valve element 16 may be operated either independently of movement of the second lever 74 or together with the second lever 74 in order to provide two modes of operation for the toilet. Further, it should be apparent that the handle may be easily manipulated to selectively obtain either mode of operation by either leaving the button 96 undepressed or depressing the button 96 during the pivoting movement of the handle 40 to flush the toilet.

Finally, it should be noted that the present invention utilizes components which are of a simple construction and which may be easily retrofit into a conventional toilet in place of existing flush mechanism components.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A toilet flush mechanism for use with a toilet including a water tank and a water outlet for conducting water out of said tank, said flush mechanism comprising:

a valve element positioned at said outlet for closing and opening said outlet;

a first actuator for moving said valve element between a fully closed position and a fully open position;

a stop member located adjacent to said valve element for engaging said valve element and limiting movement of said valve element to an intermediate position between said fully closed position and said fully open position during a first mode of operation;

a second actuator for moving said stop member away from engagement with said valve dement during a second mode of operation;

wherein said first actuator is operable to move said valve element to said fully open position during said second mode of operation;

said first actuator comprising a handle, a pivot shaft and a first lever wherein said pivot shaft includes an end supporting said handle and an opposing end supporting said first lever in said tank for pivotal movement about a pivot axis;

said second actuator including a second lever located in said tank and mounted for pivotal movement about said pivot axis, a button located on said handle and supported for movement relative to said handle, an actuator shaft located coaxial with said pivot axis and including an abutment portion, and a pawl member mounted for movement within said handle in response to movement of said button;

wherein said button is located in an unactuated position during said first mode of operation such that pivotal movement of said handle with said button in said unactuated position moves said valve element to said intermediate position, and in said second mode of operation said button is moved relative to said handle to an actuated position such that pivotal movement of said handle moves said valve element to said fully open position;

said handle pivoting independently of said actuator shaft in said first mode of operation, and, in said second mode of operation, said abutment portion being engaged with said pawl member such that said handle is coupled to said actuator shaft whereby said handle and said actuator shaft rotate together with pivotal movement of said handle.

2. The flush mechanism of claim 1 wherein said stop member comprises an elongated element having opposing ends, and one end of said elongated element is pivotally supported on a pivot within said tank and said elongated element hangs downwardly from said pivot such that the other end of said elongated element is located adjacent to said valve element.

3. A toilet flush mechanism for use with a toilet including water tank and a water outlet for conducting water out of said tank, said flush mechanism comprising:

a valve element including means supporting said valve element for movement between a fully closed position, preventing flow through said outlet, and a fully open position vertically displaced from said fully closed position, permitting flow through said outlet;

a handle supported for pivotal movement on said tank and means connecting said handle to said valve element whereby said handle is adapted to actuate said valve element in vertical movement;

a stop member having an upper end and a lower end;

a pivot connection supporting said upper end of said stop member whereby said lower end is positioned a predetermined distance from said valve element to limit upward movement of said valve element to a position intermediate said fully closed position and said fully open position;

a stop member actuator supported with said handle;

means connecting said stop member actuator to said stop member wherein said stop member actuator is adapted to move said lower end of said stop member away from said valve element to allow said handle to move said valve element to said fully open position;

said handle including a pivot shaft extending into said tank, and said stop member actuator including an actuator shaft extending through said pivot shaft into said tank wherein rotation of said actuator shaft causes said stop member to pivot about said pivot connection; and said stop member actuator including a pawl member mounted for movement within said handle and said actuator shaft including an abutment portion for engaging with said pawl member whereby said actuator shaft is caused to rotate with pivotal movement of said handle.

4. The flush mechanism of claim 3 wherein said pawl member includes an end portion extending from said handle for movement relative to said handle to define a first position wherein said handle rotates to actuate said valve element without rotating said actuator shaft and a second position wherein said pawl is positioned to engage said abutment portion to cause said actuator shaft to rotate during pivotal movement of said handle to actuate said valve element.

5. The flush mechanism of claim 3 including means for biasing said pawl member to a position where said pawl member will not engage with said abutment portion during pivotal movement of said handle.

6. The flush mechanism of claim 3 including a first lever attached to said handle and a first link connecting said first lever to said valve element, and a second lever attached to said actuator shaft and a second link connecting said second lever to said stop member.

7. The flush mechanism of claim 3 including means for adjusting said predetermined distance of said lower end of said stop member from said valve element.

* * * * *

UNITED STATES PATENT AND TRADEMARK OFFICE

CERTIFICATE OF CORRECTION

PATENT NO. : 5,680,659

DATED : October 28, 1997

INVENTOR(S) : Robert A. Gessaman

It is certified that error appears in the above-indentified patent and that said Letters Patent is hereby corrected as shown below:

In Column 5, line 43, in Claim 1 -

Replace the word --dement-- with the word --element--.

Signed and Sealed this

Thirteenth Day of January, 1998

Bruce Lehman

*Attest:*

BRUCE LEHMAN

*Attesting Officer*

*Commissioner of Patents and Trademarks*